US005575405A

United States Patent [19]

Stratton et al.

[11] Patent Number: 5,575,405

[45] Date of Patent: Nov. 19, 1996

[54] POST-MIX BEVERAGE DISPENSER WITH AN ASSOCIATED SIMULATED VISUAL DISPLAY OF BEVERAGE

[75] Inventors: Peter K. Stratton, Dearborn, Mich.; Gus J. Stratton, San Dimas, Calif.

[73] Assignee: Juicy Whip, Inc., Irwindale, Calif.

[21] Appl. No.: 634,684

[22] Filed: Apr. 18, 1996

Related U.S. Application Data

[63] Continuation of Ser. No. 406,819, Mar. 20, 1995, abandoned, which is a continuation of Ser. No. 178,473, Jan. 5, 1994, abandoned, which is a continuation of Ser. No. 707,987, May 22, 1991, abandoned, which is a continuation of Ser. No. 402,198, Sep. 1, 1989, abandoned.

[51] Int. Cl.[6] ..... B67B 7/00

[52] U.S. Cl. ..... 222/1; 222/78; 222/129.1

[58] Field of Search ..... 222/129.1–129.4, 222/178, 145, 146.6; 40/406, 407

[56] References Cited

U.S. PATENT DOCUMENTS

| | | | |
|---|---|---|---|
| 1,487,816 | 3/1924 | Sintzel . | |
| 1,654,379 | 12/1927 | Matzka . | |
| 1,659,444 | 5/1928 | Borchert . | |
| 1,760,887 | 6/1930 | Saugman | 40/406 |
| 1,782,685 | 11/1930 | Glaze et al. | 40/407 |
| 1,782,943 | 11/1930 | Stanford et al. . | |
| 1,782,944 | 11/1930 | Stanford et al. . | |
| 2,072,841 | 3/1937 | Tracey et al. | 40/130 |
| 2,203,054 | 8/1938 | Holmes . | |
| 2,741,400 | 4/1956 | Hazzard . | |
| 3,206,069 | 9/1965 | Jacobs et al. | 222/129.1 |
| 3,503,541 | 3/1970 | Jacobs et al. | 222/129.1 |
| 3,531,635 | 9/1970 | Hancock | 240/10 |
| 3,892,335 | 7/1975 | Schroeder | 222/129.1 |
| 4,160,512 | 7/1979 | Cleland . | |
| 4,366,920 | 1/1983 | Greenfield, Jr. et al. | 222/146.5 X |
| 4,419,283 | 12/1983 | Schneider | 252/600 |
| 4,538,636 | 9/1985 | Cleland . | |
| 4,544,084 | 10/1985 | Cleland . | |
| 4,631,210 | 12/1986 | McGee et al. | 40/406 |
| 4,676,401 | 6/1987 | Fox et al. | 222/129.1 |
| 4,686,784 | 8/1987 | Smithies | 40/406 |
| 4,728,005 | 3/1988 | Jacobs et al. . | |
| 4,856,676 | 8/1989 | Emody | 222/129.1 X |
| 4,955,507 | 9/1990 | Kirschner et al. | 222/129.4 X |

OTHER PUBLICATIONS

"There's nothing sticky . . . ", Cleland Sales Corp., Los Alamitos, CA Quality Beverage Dispenser–Starline, Dripvent Corp., Goleta CA 1980.

"Dispensers–Starline; Cornelius Inc., Anoka, MN 1989 What they see . . . "; Jet Spray Corp., Norwood, MA.

"Visual Display Dispensers"; Jet Spray Corp., Norwood MA.

*Primary Examiner*—Gregory L. Huson

*Attorney, Agent, or Firm*—Rader, Fishman & Grauer PLLC

[57] ABSTRACT

A beverage dispenser provides a housing supporting a sealed transparent display bowl containing a permanent sterile and stable fluid simulating the color and texture of a beverage to be dispensed. A generally conventional post-mix system supplies pressurized water and beverage concentrate to a cylindrical mixing chamber that is closed at one axial end and has an outlet at the opposite end for dispensing the mixed beverage. The pressurized water and concentrate are directed chordally against each other within the mixing chamber such that they impinge and mix in a spiral flow around the cylindrical periphery of the mixing chamber in the general direction of the water and toward the outlet. The display bowl is mounted on the housing and is partially filled by a hollow spacer having a bottom opening. A refrigerator tower for cooling the water flowing therethrough prior to mixing is supported by the housing and extends upright through the bottom opening into the hollow spacer.

12 Claims, 3 Drawing Sheets

60

66
10
65
39
71
41
62
48
61
11
31
42
34
19
27
33
32
17
25
21
26
22
63
16
24
18
12
14
13
15

POST-MIX BEVERAGE DISPENSER WITH AN ASSOCIATED SIMULATED VISUAL DISPLAY OF BEVERAGE

CROSS REFERENCE TO RELATED APPLICATIONS

This application is a FWC of application Ser. No. 08/406,819, filed Mar. 20, 1995, now abandoned; which is an FWC of application Ser. No. 08/178,473, filed Jan. 5, 1994, now abandoned; which is a FWC of application Ser. No. 07/707,987, filed May 22, 1991, now abandoned; which in turn is a FWC of application Ser. No. 07/402,198, filed Sep. 1, 1989, now abandoned.

1. FIELD OF THE INVENTION

This invention relates in general to fountain-type dispensers and in particular to the provision of a transparent holding tank or bowl for displaying a simulated beverage for use in post-mix type beverage dispensers.

2. THE PRIOR ART

For years, two basic types of fountain dispensers have been available to the trade, referred to respectively as "pre-mix" and "post-mix" dispensers.

Pre-mix dispensers mix a syrup concentrate and water to provide a finished beverage which is then stored in a holding tank until dispensed through a faucet located on the dispenser. The holding tank may be opaque, or transparent for display purposes, and is usually referred to as a "bowl".

Post-mix dispensers do not pre-mix and store the syrup and water. Instead, the syrup and water are conveyed by separate conduits to a dispenser housing and then mixed immediately prior to being dispensed through the usual faucet on the housing. The syrup may be stored remotely from the dispenser housing in a metallic cylinder, or in a collapsible plastic bag in a cardboard box known to the trade as "bag in box". The water source may be the available municipal water line.

The advantages of the pre-mix and post-mix dispensers with respect to each other give rise to inherent disadvantages in each. The resulting problems that have confronted the prior art are briefly summarized as follows:

The pre-mix dispensers available heretofore having a transparent display bowl or holding tank obtain the advantages of a visual beverage display that is a powerful merchandising tool for stimulating impulse buying. On the other hand, the display bowls require frequent cleaning and have small dispensing capacity that require frequent manual filling, or the added expense and complexity of automatic filling.

The post-mix dispensers available heretofore without a transparent display bowl or holding tank of course have no bowl to clean, but have large dispensing capacity and automatic mixing. They in turn provide no visual display of the beverage and consequently lose a powerful merchandising tool.

A typical pre-mix dispenser comprises the assembly of a refrigeration unit mounted on a counter and a display container for the beverage mounted on and above the refrigeration unit. A cover or lid for the open top of the display bowl is removable to enable refilling. The container may contain a mechanism for agitating the beverage to maintain homogeneity for pulpy juices and uniform cooling of the beverage, or merely to enhance the attractiveness of the beverage display. The display bowl is usually mounted over a stainless steel refrigeration tower in direct contact with the beverage. The beverage is typically dispensed by holding a cup under a dispensing faucet on the unit and pushing the cup against a valve actuating lever to open the faucet.

Among several significant problems associated with the pre-mix dispenser, maintaining a clean transparent display bowl has long been particularly burdensome to the trade. Usually within a week or so after cleaning the bowl, bacterial growth and an unsightly particulate residue or film on the interior surfaces of the bowl and parts in contact with the beverage necessitate recleaning, and any beverage remaining in the bowl is frequently unappetizing in appearance or unfit for consumption and must be discarded. Adequate cleaning involves appreciable cost for conscientious labor and requires the draining of residual beverage from the bowl, disassembly of various conduits, couplings, valves and the agitating mechanism within the bowl, careful and thorough washing of the bowl and parts, and thereafter their reassembly. When conscientious labor is not applied, bacterial formation after cleaning is even more rapid and the visual display becomes a detraction rather than an inducement to consumption.

The cleaning must be done regardless whether the bowl is manually filled or is connected to an automatic filling device. The process is time consuming, messy, and requires technical skill and training as well as dexterity. These are important considerations since labor in the fast food industry tends to be either young or elderly and unskilled. Employees tend to dislike the cleaning job and therfore try to avoid or delay it. In consequence, sanitation becomes a serious problem closely related to beverage appearance. An attractive visual display, especially for fruit juices, is of utmost concern to the trade, wherein even the quantity of beverage in the display bowl is critical. Optimum sales result when the display bowl is about three-quarters full.

Misassembly of parts after cleaning often results in malfunction of the dispenser with resulting downtime and service calls, or breakage of fragile parts which have to be purchased. Also assembly and reassembly increases wearing of the parts. These factors, in addition to employee time spent in the cleaning process, increase maintenance cost.

Recognition of the importance of an attractive visual display and the cleaning problems associated with display containers for pre-mix beverage dispensers is well documented by the art and the major manufacturers of such dispensers. Their manuals for example advertise automatic filling units for counter top visual display beverage dispensers to create impulse sales and to electronically control the product level in the bowl for peak appeal. They also describe the complexities of cleaning and sanitizing such products while noting that cleanliness is the most important factor in maintaining a high standard of performance—the dispenser should be disassembled and cleaned on a regular basis.

A specific narration of the cleaning problems associated with display bowls is set out in the Fox et al U.S. Pat. No. 4,676,401, which states in order to emphasize the advantages of their post-mix dispenser:

> "Typically these beverages are made from a combination of a concentrate and a diluent, usually water. The concentrate by itself generally does not require refrigeration and has a shelf life of several months to over a year. However, when mixed with a diluent such as water or exposed to air, the combined beverage usually requires refrigeration to retard bacterial growth . . . . "

"Pre-mixed dispensers suffer from a number of disadvantages. Even with refrigeration, some bacterial growth is present. Consequently, after a period of time, typically a few days, any remaining pre-mixed beverage should be discarded to maintain healthy quality and a pleasing beverage taste."

Fox et al solve the cleanliness problems associated with a beverage display bowl in the same way all post-mix dispensers do, i.e., by eliminating the display bowl—and of course all the desirable features of visual display.

The pre-mix dispenser also has the disadvantage of a low volume dispensing capacity for the display bowl, which usually contains about three gallons of finished beverage in a 5:1 water:syrup ratio. Accordingly fresh batches of syrup and water must be carefully mixed, often while customers are waiting, then poured into the open top of the container. Alternately, the water and syrup are poured into the bowl separately and then manually stirred. When this is done, care must be taken to pour the water in before the syrup, otherwise jamming of the agitating device can occur. These procedures are customarily carried out by hand.

Inasmuch as the concentrated syrup requires large volumes of water in a predetermined ratio, careful proportioning is required to provide a suitable drink, and such careful proportioning is not always achieved, rendering the drink too weak or too strong. Also, in order to fill the display bowl, the waitress or person in charge of dispensing must raise the water and syrup above the display bowl on the counter and pour the liquid into the open top. Spilling may result and additional labor is required to clean a sticky mess. After the display bowl is refilled, time is frequently required to cool the freshly mixed beverage—with customers waiting.

Post-mix dispensers avoid the problems associated with cleaning the display bowl and its parts because there is no display bowl. Sanitation has not been a problem because for all practical purposes, syrups are not biologically active in their concentrated form. Bacterial growth accelerates and becomes problematic only after the syrup has been diluted with water for several days. Inasmuch as the syrup and water are not mixed in post-mix dispensers until the beverage is ready to be consumed, it follows that bacterial growth is not a problem. Post-mix dispensers do not have a low volume dispensing capacity problem because the large syrup capacity of the bag-in-box or storage cylinders and the mixing of the syrup and water at the time the drink is dispensed provide a vastly greater dispensing capacity than possible with pre-mix dispensers. When the bag-in-box or cylindrical containers are empty, they are readily replaced by full containers.

Manual refilling is not a problem with post-mix dispensers, again, because there is no display bowl to refill and the syrup and water are mixed automatically. Thus the post-mix dispensers indeed avoid the problems of cleaning, filling and low dispensing capacity, but do so by eliminating the display tank which is universally regarded as a most important inducement to beverage consumption and increased sales. In particular, it is well known by the trade that colored drinks such as orange, punch, and even lemonade simply do not sell well unless they are visually displayed in a transparent bowl. The visual display is assuming even greater importance in recent marketing projections which predict that the consumption of beverages containing 10–15% fruit juices will progressively capture larger shares of the soft drink market.

In recognition of the importance of the visual display containers, the art has made various attempts to combine some of the advantages of the post-mix dispenser with the customary display container. As taught by U.S. Pat. Nos. 4,160,512; 4,538,636; and 4,544,084 to Cleland and 4,728,005 to Jacobs et al, a self-fill system or automatic mixing device supplies water and syrup concentrate from concealed sources in metered quantities to a mixer from which the premixed beverage is conducted to an otherwise conventional display container when the beverage level therein falls to a predetermined level. The self-fill system avoids the problems associated with frequent hand mixing and refilling of the display container, but it introduces its own set of problems, including complex plumbing and additional cost for the dispenser, and it does not solve the more important problem of maintaining a clean and inviting beverage display.

The problems associated with automatic mixing devices for beverage dispensers and cleaning the same are highlighted by literature published by the Cleland Sales Corp., which has been particularly active in attemps to provide a superior transparent-bowl type beverage dispenser, yet avoid their problems. Regardless of Cleland's efforts, the problem of maintaining a clean transparent display bowl for a pre-mix beverage dispenser are not solved, although such problems are clearly recognized by the Cleland literature.

Cleland provides an auto-mix unit for mixing water and concentrate that replaces the removable lid for the conventional beverage display container. The concentrate and water may be supplied to the auto-mix unit from concealed and remote sources, and after mixing are conducted to the display bowl for cooling and dispensing in the customary manner. Cleland's advertising literature not only includes several pages of maintenance and cleaning instructions, but points out the problems of manual mixing and filling associated with pre-mix type display bowls:

"Up until now, keeping your beverage dispenser full has been a little sticky. There's been the problem of slop-over. The step-ladder balancing acts. And maintaining the kind of beverage consistency and quality that guarantees repeat sales. But most important, there have been those lunch time crunches when you've ended up having to refil your beverage dispenser. Busy times when your labor could have been used somewhere else .... The auto-mix unit is designed to automatically mix beverage syrup with the proper amount of water and provide a constant level of beverage in the dispenser bowl."

Dispenser and beverage manufacturers have been unable to provide a dispenser with a transparent display bowl while avoiding the burdens of cleaning and filling the bowl and the associated problem of low dispensing capacity. In an attempt to solve at least the problem of low dispensing capacity, cumbersome automatic filling devices have been developed. Such devices have not been widely successful. They have been designed for attachment to existing display bowls utilizing complicated mechanical and electrical means, and thus as noted above, bring along a host of new problems including increased cost, diminished aesthetics, and the exacerbation of the cleaning problems because the automatic filling devices have components that also require cleaning and maintenance. Although the filling and low dispensing capacity problems have been solved in a fashion, the most serious problem, cleaning, has not been solved.

In short, regardless of the recognition of the above mentioned problems with pre-mix and post-mix dispensers and the incentives for eliminating such problems, there has been no previous insight to provide the necessary structures for simply and effectively solving these problems. A patent to Hazzarad U.S. Pat. No. 2,741,400 discloses a sealed display container 48 for a suitable fluid corresponding in color and substance to the juice of the edible is mounted above a dispensing unit 12 containing a refrigerated container 18 for a premixed beverage. The patent does not address the problems associated with the task of cleaning the tank 18 and of mixing a syrup concentrate and water in proper proportions for filling the tank 18. Although the tank 18 is concealed from view, it still must be cleaned periodically to eliminate mold and bacterial growth that otherwise would render the beverage unfit for consumption.

3. OBJECTS OF THE INVENTION

Important objects of the present invention are to provide a post-mix type beverage dispenser with a clear, transparent, visual display bowl containing a permanent simulated beverage, and to provide a superior formulated bacterial resistant liquid for the bowl which simulates the actual beverage to be dispensed and which indefinitely maintains the characteristic color and consistency of the actual beverage.

Other objects are to provide an improved construction and arrangement of parts in such a dispenser that reduce the quantity of simulated beverage required to fill the display bowl, yet enable the simulated beverage to be maintained at a predetermined desirable level within the bowl, and which enable the provision of an enlarged and more effective refrigeration unit and a correspondingly more effective and more rapid cooling of the dispensed beverage without increasing the overall size or height of the dispenser.

Other objects are to provide such a dispenser that eliminates the need for frequent disassembly, washing and reassembly of the display bowl and associated parts, eliminates manual mixing of water and concentrate to prepare the beverage; and eliminates manual filling of the display bowl, as well as the need for an automatic filling device for the display bowl without incurring the problem of low dispensing capacity associated with transparent display bowls now in use.

Another object is to provide such a dispenser that can be used with or without a whipping element and which provides simple and improved means for mixing water and concentrate, even thick concentrates that are otherwise difficult to mix without a mechanical agitator, whereby without recourse to a whipping element, a non-whipped but thoroughly mixed beverage can be dispensed, and whereby with the aid of a whipping element, thoroughly mixed water and concentrate can be whipped and dispensed as a frothy beverage.

4. SUMMARY OF THE INVENTION

In accordance with a preferred embodiment of the present invention, the most desirable features of both the pre-mix and post-mix beverage dispensers are preserved by providing a beverage mixing dispenser unit for receiving and mixing a diluent, usually but not necessarily water, and a concentrated syrup from separate concealed sources remote from a dispenser housing to produce a potable beverage, in combination with a faucet connected with the unit to receive and dispense the mixed beverage, and a sealed transparent display bowl for a sterile fluid formulated and colored to simulate the beverage for the purpose of stimulating impulse consumption. Preferably the fluid comprises a stable formulation that is a solvent for reactive polymeric dyes, such as reactant urethane colorants conventionally employed to color polyurethane foam, that maintain their initial characteristics indefinitely at ordinary temperatures and will not support the growth of the bacteria and mold that have required cleaning heretofore. A preferred fluid is an alcohol, such as polypropylene glycol by way of example. Also preferably means are provided for agitating the fluid to effect the appearance that it is flowing freshly into the container.

A preferred colorant in the formulation comprises a polymeric dye soluble in a polyol and available in a wide range of colors. It may comprise a polyol having a chromogen chemically bound to a polymer. The formulation may be rendered cloudy and opaque by adding a suitable dispersoid, which may be a colloidal or an emulsified ingredient, as for example an alkenyl modified oxyalkylene polymer to simulate a pulpy beverage such as orange juice. The preferred colorant and pulpy ingredients remain dispersed uniformly within the fluid for extended time periods and may be obtained from Union Carbide Company, which identifies the pulpy ingredient as Polyol E 561 sold under its brand name NIAX. Other formulations may of course be used having similar characteristics, and the agitating means enhances uniform dispersion of the colorant and pulpy ingredients.

The improved mixing means comprises a cylindrical mixing chamber having an outlet at one end and mirror image inlet ports for water and fluid concentrate that direct these fluids chordally against each other and the cylindrical wall of the chamber at a location remote from the outlet, whereby the higher water velocity reverses the direction of the concentrate in a spiral flow around the cylindrical periphery of the mixing chamber and toward the outlet to effect thorough mixing without recourse to a mechanical agitator.

The exterior of the display bowl may be conventional in size and general appearance, but it contains a hollow sealed spacer comprising an inverted container having an open bottom and a closed top from which side and end walls extend to and are sealed to the bottom of the bowl. The central portion of the spacer top may be adjacent to the top of the bowl. The lateral portions of the spacer top are concealed below the normal level of the fluid simulated beverage and preferably support agitating mechanism for the fluid, which is also concealed below the fluid level. The hollow central portion of the spacer provides a cavity into which the upper portion of a refrigeration tower extends from a supporting housing for the refrigeration assembly and on which the display bowl is supported. Accordingly a comparatively small quantity of simulated beverage within the bowl gives the appearance of a full bowl, and a larger more effective refrigeration tower for cooling the beverage may be provided without increasing the overall size of a conventional dispenser.

The advantages of the present invention will appear in the following description and appended claims, reference being had to the accompanying drawings forming a part of this specification wherein like reference characters designate corresponding parts in the several views.

5. BRIEF DESCRIPTION OF THE DRAWINGS

Figure 1:
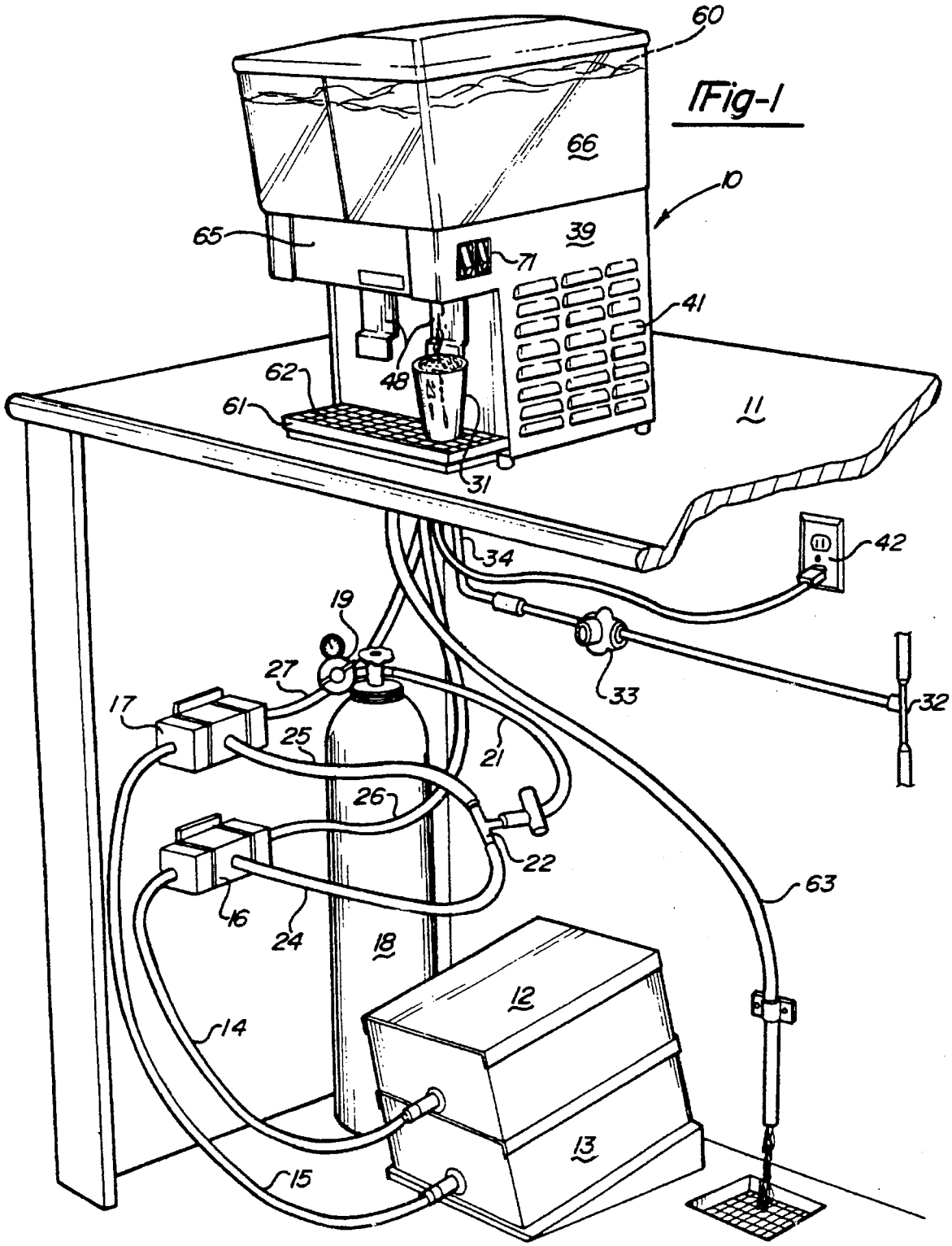
FIG. 1 is a diagramatic perspective view of a beverage dispenser embodying the present invention, showing the countertop display bowl with its auxiliary equipment located below the counter and concealed from public view.
Figure 2:
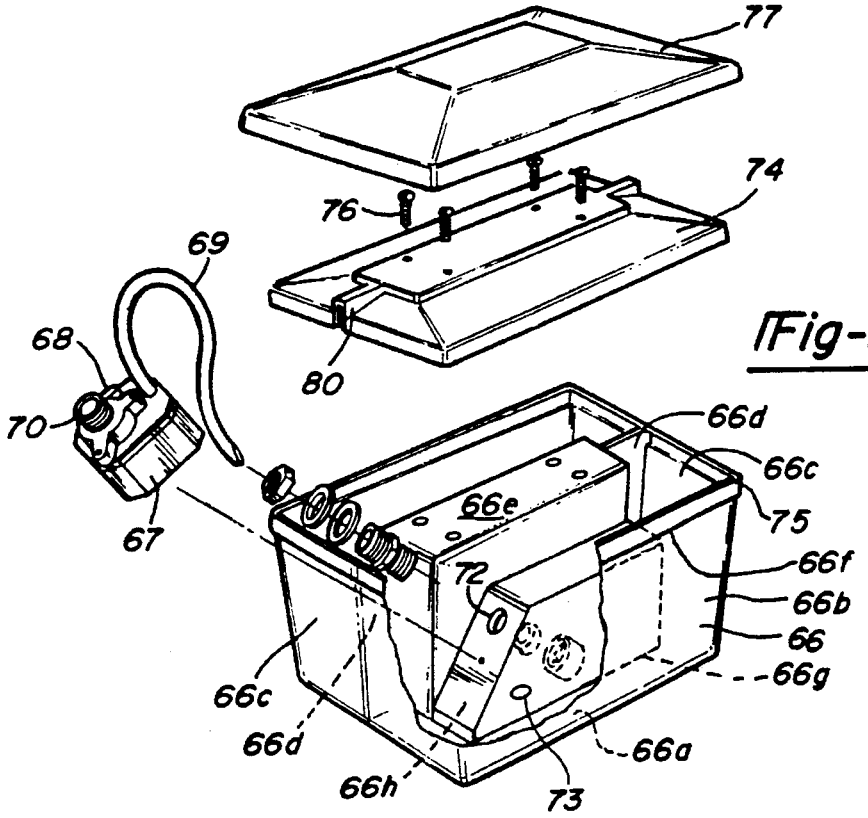
FIG. 2 is an exploded perspective view of the transparent display bowl illustrated in FIG. 1.
Figure 3:
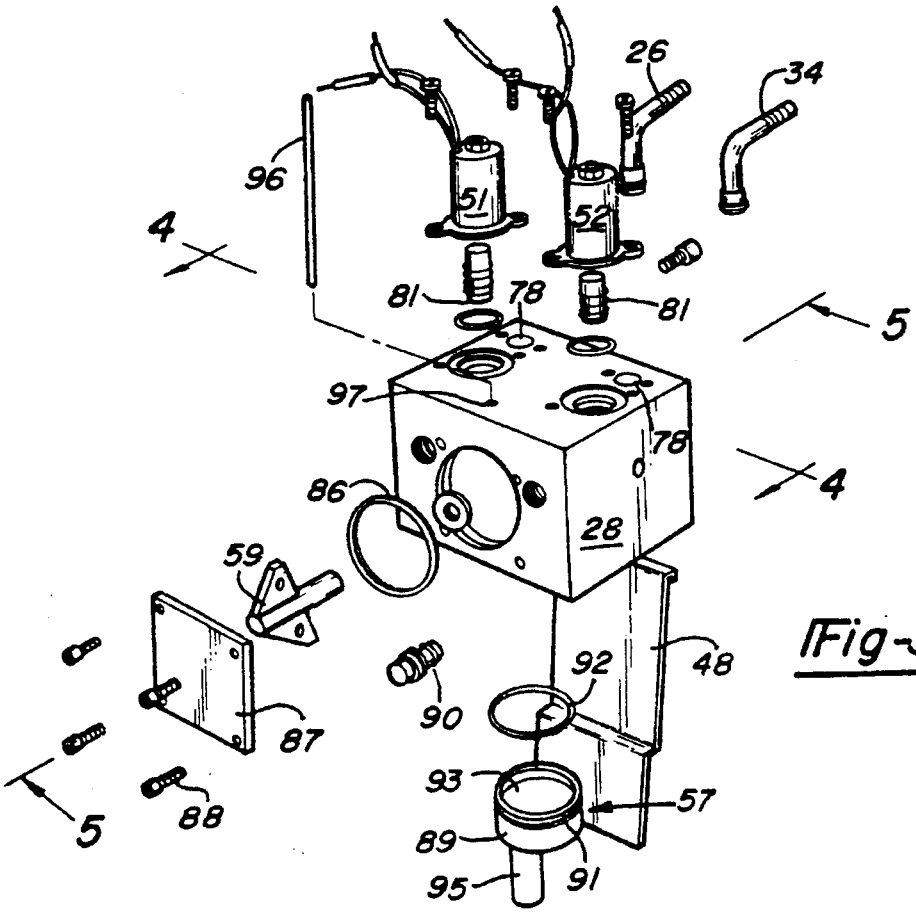
FIG. 3 is an exploded perspective view of one of the valve block assemblies.

It is to be understood that the invention is not limited in its application to the details of construction and arrangement of parts illustrated in the accompanying drawings, since the invention is capable of other embodiments and of being practiced or carried out in various ways, and that the phraseology or terminology employed herein is for the purpose of describing the invention claimed in the appended claims.

6. DESCRIPTION OF A PREFERRED EMBODIMENT

Referring to the drawings, a beverage dispenser 10 embodying the present invention is supported by way of example on the top of a counter 11 of a food serving establishment. Below the counter 11 and preferably concealed from public view is auxiliary equipment comprising sources 12 and 13 for two different beverage concentrates, such as orange and lemon, for mixing with water to provide a fruit juice beverage. The sources 12 and 13 may each comprise what is known to the trade as a bag-in-box source of concentrate comprising a replaceable collapsible plastic bag filled with the concentrate and contained within a cardboard box. The collapsible bags within the boxes 12 and 13 are connected by separate conduits 14 and 15 to separate pumps 16 and 17 powered, as for example by gas pressure, which may be compressed carbon dioxide stored in a tank 18 equipped with a pressure regulator 19 to supply regulated gas pressure via conduit 21 to a juncture 22 and thence by separate conduits 24 and 25 to the pumps 16 and 17 respectively. The latter may be conventional and pump the associated concentrates via conduits 26 and 27 to separate mixing blocks 28 and 29, wherein the concentrates are mixed with water on demand and dispensed in a customary manner as described below into a container or cup 31. The spent carbon dioxide gas is exhausted from the pumps 16 and 17 to atmosphere without coming into contact with the concentrate.

Figure 6:
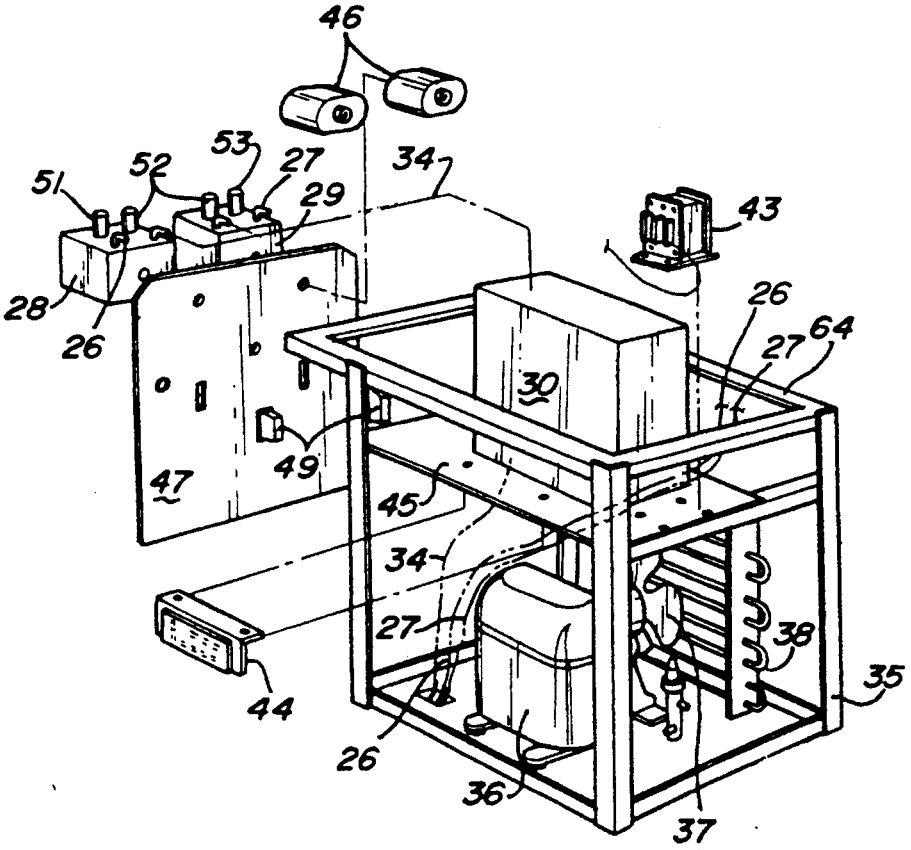
FIG. 6 is an exploded perspective view of the supporting frame for the display bowl, illustrating the arrangement of important operating parts for the dispenser.

The water for mixing may be obtained from the available public water supply 32 and is conducted via pressure regulator 33 and water line 34 to the valve or mixing blocks 28 and 29. Prior to entering the mixing blocks 28, 29, the water conduit 34 preferably passes through an insulated refrigerator tower 30, FIG. 6, cooled conventionally by a refrigeration assembly including a compressor 36 and fan 37. The latter dissipates heat from condenser coils 38 that conventionally connect compressor 36 and cooling coils within refrigerator tower 30. After cooling the refrigerator 30, the refrigerant is returned conventionally to the compressor 36 to complete the refrigeration cycle. The compressor 36 and fan 37 are electrically powered and the entire refrigeration assembly is enclosed within a housing frame 36 supporting exterior trim panels 39, FIG. 1, some of which may be louvered as at 41 to facilitate escape of heat from the condenser 38. The refrigerating assembly may also be conventional and operates to chill the water in line 34 as it passes through coils in tower 30 on its way to the blocks 28 and 29. Preferably the refrigeration assembly is thermostatically controlled to prevent overchilling and to maintain a reasonably constant cold temperature for the water passing therethrough. The concentrate is usually too thick to be refrigerated. It is thus pumped directly from pumps 16 and 17 to the blocks 28 and 29, respectively. The refrigeration assembly may be omitted in some instances where the beverage is served with cracked ice in the cup 31.

Suitable electric power 42, which may be 110 V.A.C., may be supplied directly to the motors for the compresser and fan and in parallel to a transformer 43 and thence to a terminal strip 44 by electric leads not shown. The refrigerator tower 30, transformer 43, and strip 44 may be supported by a platform 45 mounted in the frame 35 above the compresser 36 and extending only partly across the width of the frame 35 to provide a passage for the conduits 26, 27 to the blocks 28, 29, and for the conduit 34 and refrigerant from coils 38 to the refrigerator tower 30. The valve blocks 28, 29 and associated motors 46 for the beverage whipping means, where whipping is desired, may be supported by a vertical front panel 47 secured to the forward end of the frame 35.

When beverage dispensing is desired, the cup 31 is pressed rearwardly against one of the push levers 48 pivotally mounted on the exterior surface of the panel 47. Each lever 48 is associated with one of the beverages to be dispensed and actuates an associated switch 49 which in turn actuates an associated set of solenoid operated valves 51, 52 or 53, 52 in the appropriate block 28 or 29 to open ports in their water and concentrate lines 34, 26 or 34, 27 and admit the flow of water and concentrate into the cylindrical mixing chamber 54 of the appropriate block 28 or 29. The water and concentrate are supplied under predetermined pressures determined by the water regulator 33 and the associated pump 16 or 17 to assure mixing of the water and concentrate in proper proportions within the chamber 54, from which the mixed beverage is dispensed through outlet 56 and funnel 57 opening from the lower forward portion of the chamber 54.

If whipping of the mixture is desired, actuation of the switch 49 also activates the appropriate motor 46 to rotate the motor driven shaft 58 and the coaxially connected whipper blade 59. Each shaft 58 extends coaxially into its chamber 54 and through suitable seals in the rear end wall of the associated block 28 or 29 to prevent leakage of beverage from the chamber 54. A drip tray 61 containing a grid 62 is provided to underlie the cup 31 and enable passage of beverage overflow via drain line 63 to a drain, FIG. 1.

The structure described thus far and its operation may be conventional for post-mix dispensers and are accordingly not considered in further detail.

The frame 35 provides a rectangular top 65 cantilevered forwardly to overlie the valve blocks 28, 29 whereby they are conveniently concealed by a forward outer trim panel 65, FIG. 1. Also supported on the frame top 64 is a sealed transparent display bowl 66 having a bottom **66*a* overlying the frame portion 64 and overlapping the same for appearance. Lateral plates 66*b* and fore and aft plates 66*c* diverge upwardly from the bottom 66*a*, again for appearance. An upright longitudinal divider partitions the bowl 66 into two lateral portions for receiving two separate fluids and includes vertical end portions 66*d* and a centrally located spacer 66*e* having a flat top flush with the tops of the divider parts 66*d* and upper edges of the plates 66*b* and 66*c*. The front, rear, and lateral sides of the spacer 66*e* extend vertically from the bottom 66*a* and are secured and sealed thereto to reduce the amount of fluid required to fill the bowl 66. The spacer 66*e* may be hollow and may be formed as a unitary molded structure with the remainder of the bowl 66. The upper edges of the plates 66*b* and 66*c* are reinforced by a double thickness reinforcement 66*f*** of the bowl material, which may be a clear hardened plastic.

Also within each lateral partition of the bowl 66 is a second spacer 66*g* having a flat top parallel to the top of spacer 66*e* but of reduced height so as to be concealed when the bowl 66 contains the desired amount of fluid. The mesial side of the spacer 66*g* may open into the adjacent lateral side of the hollow spacer 66*e* and is sealed around its periphery to the adjacent lateral side wall of spacer 66*e*. The lateral and rear side walls of the spacer 66*g* are preferably vertical and extend to the bottom 66*a* to which they are also secured and sealed. The forward end 66*h* of spacer 66*g* inclines rearwardly at approximately a 45° angle to provide a supporting platform on which a conventional fluid jet mechanism 67 is mounted.

Each lateral spacer 66*g* is preferably hollow and sealed to prevent entry of fluid from the interior of bowl 66, but contains electrical power line 69 for the pump motor within the mechanism 67 that forces a jet of fluid through nozzle 68 substantially in parallelism with the inclined platform 66*h*, thereby to agitate the fluid 60 within the bowl 66, FIG. 1, and simulate the appearance of an inflow of fresh beverage. The fluid discharged from nozzle 68 is replaced within the mechanism 67 via an inlet 70, whereby the fluid within bowl 66 is recirculated through the jet mechanism 67 continuously, at the option of the operator, by operation of one of two electrical switches 71 to power the pump within the mechanism 67. Each of the switches 49 is operative to actuate one of the solenoid sets 51, 52 or 52, 53 when the other switch 71 is closed.

The two spacers 66*g* at opposite sides of the spacers 66*e* and their jet mechanisms 67 may be mirror images of each other. The electrical lead 69 for each jet mechanism 67 extends through a sealed opening at 72 in the associated inclined support 66*h* and thence through a second sealed opening at 73 through the bottom 66*a* and is suitably connected to the transformer 43 via terminal strip 44.

The hollow sealed spacers 66*e*, 66*g* not only occupy appreciable space within the bowl 66 and reduce the quantity of fluid 60 required to fill the bowl 66 to any desired level, they also provide space for the upper end of the refrigerator tower 30, enabling use of a larger tower 30 and more rapid cooling of the water conduit 34 coiled therein than otherwise possible without increasing the overall size of the dispenser 10. Additionally, the level of fluid 60 within bowl 66 also conceals the spacer 66*g* and agitator 67.

The open top of the display bowl 66 is sealed closed by a removable cover 74 that seals against a peripheral seal 75 overlying the double thickness top 66*f*. Opposite ends of cover 74 provide raised projections 80 having downwardly opening locating grooves for snugly receiving the upper edges of the vertical dividers 66*d* to locate the cover 74 accurately with respect to the spacer 66*e*. Bolts 76 screw into the top of spacer 66*e* to clamp the top 74 tightly in sealed relationship against the seal 75. An ornamental cover 77 removably overlies the sealed cover 74. Replacement of the fluid 60 in bowl 66, or a change in the type of fluid 60 to simulate a different beverage, may be readily accomplished by removing the covers 74 and 77. Although any stable sterile fluid 60 formulated to simulate the beverage being dispensed may be used, the above described alcohol formulated to simulate the color and texture of the beverage as described above is preferred because of its exceptional stability and resemblance to the real beverage.

The foregoing discloses the unique combination of a post-mix beverage dispenser 10, a sealed transparent display bowl 66, and a stable sterile fluid 60 within the bowl formulated to simulate the color and texture of the beverage to be dispensed, whereby the advantages of both the post-mix and pre-mix dispenser are obtained and their attendant disadvantages are avoided. At the outset, the universally recognized requirement of visual display essential for stimulating optimum consumption of a fruit juice type beverage is obtained without the above-noted problems of mold and bacterial growth associated with pre-mix display bowls: i.e., frequent discarding of spoiled beverage and cleaning of the display bowl and its auxiliary equipment, reassembly and occasional breakage of such equipment during the cleaning, mixing fresh concentrate and water to replace the spoiled beverage, pouring the mixture into the bowl with occasional spillage by careless or unskilled employees, necessitating a sticky cleanup, and an inferior beverage resulting from improper proportioning of the fresh concentrate and water. In addition, the post-mix character of the present invention enables a long-lasting supply of concentrate that is automatically mixed with water in proper proportions on demand for immediate consumption, whereby the problems associated heretofore with auxiliary equipment for refilling pre-mixed display bowls are also eliminated.

Figure 4:
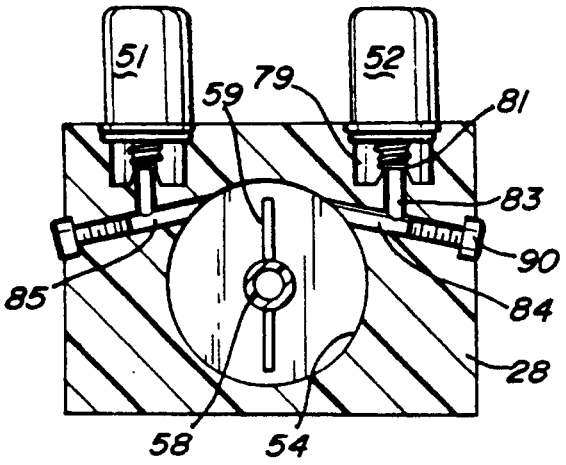
FIG. 4 is a sectional view transverse to the rotational axis of the whipper blade, taken in the direction of the arrows essentially along the line 4—4 of FIG. 3.
Figure 5:
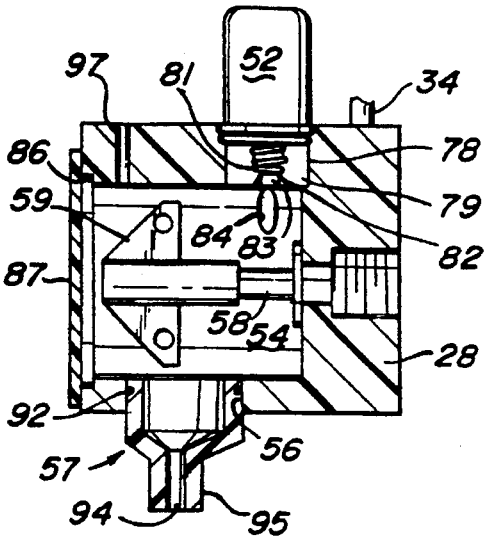
FIG. 5 is a vertical sectional view along the rotational axis of the whipper blade, taken in the direction of the arrows essentially along the line 5—5 of FIG. 3.

In regard to the broadest concept of the combination of the post-mix type beverage dispenser and the sealed display bowl, the two separate fluids, i.e., the water and concentrate, may be mixed entirely within a mixing-whipping chamber as disclosed in the Fox et al U.S. Pat. No. 4,676,401, or may be mixed either partially or entirely in the supply conduits to a mixing-whipping chamber as disclosed in the Harrison U.S. Pat. No. 4,747,692. An improved and preferred mixing-whipping chamber however is illustrated in FIGS. 4 and 5. The two valve and mixing blocks 28 and 29 are the same in structure and operation, except that block 28 mixes water with the concentrate from source 12 and block 29 mixes water with the concentrate from source 13. Accordingly only block 28 is illustrated in FIGS. 4 and 5. The water conduit 34 from the refrigerator unit 30 and the concentrate conduit 26 from pump 16 communicate with similarly arranged passages in the block 28, which in fact may be mirror images of each other. Thus only the water passage is illustrated schematically in FIG. 5.

The water conduit 34 is connected via passage 78 in the block 28 with an opening 79 containing a valve plunger 81 operated by solenoid 52. The opening 79 communicates via port 82 with a dogleg passage 83 that opens into an inclined duct 84, FIG. 4. The comparable inclined mirror image duct 85 for the concentrate is similarly connected to its concentrate duct 26. The ducts 84 and 85 are formed by bores that incline inwardly through opposing sidewalls of the block 28 at approximately 60° to its longitudinal axial midplane and enter the cylindrical wall of the mixing chamber 54 at locations such that the pressurized fluid concentrate and water impinge adjacent to the upper surface of the chamber 54 at said longitudinal midplane. The pressure of the water and its flow velocity into the chamber 54 is usually greater than that of the concentrate. The water thus overpowers and reverses the direction of the concentrate flow to effect a superior mixing in a spiral flow of the water and concentrate around the cylindrical wall of the chamber 54 and downstream toward the chamber outlet 56. The spiral flow of the mixed water and concentrate hugs and usually completes about four spirals around the cylindrical wall of the mixing chamber 54 before the mixed beverage reaches the whipping blade 59, or outlet 56 if there is no blade 59. The exterior openings for the bores that form passages 84 and 85 are sealed by screw plugs 90. Similarly, horizontal bores through the front face of the blocks 28, 29 and extending rearwardly to provide part of the conduits 83 and are also sealed by screw plugs 90 at their forward ends. The front end of the cylindrical mixing chamber 54 is sealed closed by an O-ring seal 86 and an endplate 87 clamped by screws 88 to the front end of block 28.

Some beverages such as a comparatively thick drink known as Rica Horchata, thickened with rice flour and cinnamon and favored by many people in the southwest, are preferably not whipped. Such thick beverages have been difficult to mix heretofore without mechanical agitation. The structure described enables satisfactory mixing of the Rica Horchata beverage without use of the whipper blade 59. Thus the latter is not necessary and its expense and that of motor 46 may be eliminated when only such beverages are to be dispensed.

The outlet 56 comprises a cylindrical hole centered on the longitudinal midplane of the chamber 54 directly below the blade 59 and has a diameter approximately equal to the axial length of the blade 59. The funnel 57 has an upper cylindrical collar 89 dimensioned to fit snugly and slidably within the outlet 56. An annular outwardly opening groove 91 adjacent to the upper end of collar 89 receives an O-ring seal 92 that effects a seal between the exterior of the collar 89 and the interior of the outlet 56 and also frictionally secures the funnel 57 in rotatably adjusted positions. The base 93 of the collar 89 extends at a slight downward angle to facilitate drainage from the funnel 57 and is provided with a bore 94 offset from the vertical axis of the collar 89. The bore 94 opens coaxially into an integral depending tubular spout 95 for directing the dispensed beverage into the cup 31. By rotating the funnel 57 about the axis of the collar 89, limited adjustment of the offset axis of the spout 95 with respect to the center of the cup 31 is enabled. Also the offset location of the bore 94 in the base 93 effects an offset and increased turbulence in the beverage flow from the chamber 54, thereby to inhibit splashing as the beverage enters the cup 31. An air inlet tube 96 frictionally secured within an opening 97 in the wall of the block 28 extends from the atmosphere into the chamber 54 to prevent formation of a vacuum therein and to provide air for the whipped beverage.

It is believed that operation of the beverage dispenser is apparent from the foregoing. Initially, separate formulations of the fluid 60 are poured into the separate compartments at opposite sides of the display container 66 to simulate two different types of beverage corresponding to the different concentrates within sources 12 and 13. Preferably the bowl 66 is filled approximately three-quarters of the distance from the bottom to the top. Such partial filling has been found to be most effective in stimulating consumer demand. Thereafter the cover 74 is secured in place to seal the bowl 66 and the ornamental cover 77 is applied.

At the beginning of the business day, one of the switches 71 is actuated to energize the refrigeration assembly and to enable closing of electrical circuits to the whipping motors 46 upon subsequent actuation of the switches 49. Closing the other switch 71 energizes the motors for the jet assemblies 67. The refrigeration assembly is conventionally controlled by thermostatic means to maintain a uniform cooling effect on the water passing through the refrigerator 30 to the mixing blocks 28 and 29. When it is desired to dispense a beverage, a cup 31 is pressed against one of the switch operating levers 48 to activate the associated switch 49 and thus energize the associated whipping motor 46 and the associated pair of solenoid valves 51, 52 or 53, 52. Energizing solenoid 52 raises the solenoid valve plunger 81 from its seated position closing port 82, initiating flow of chilled water through its conduit 34 from the refrigerator 30 and into the conduit system 78, 79, 83, and 84 into the whipping chamber 54.

The simultaneous energizing of solenoid 51 or 53 opens a port 82 in the associated concentrate line to enable flow of pressurized concentrate from the pump 16 or 17 and into the mixing chamber 54 via inclined duct 85 of the associated block 28 or 29 in a manner similar in all respects to the above described flow system for the water into the inclined duct 84. Water and concentrate ejecting from the conduits 84 and 85 impinge adjacent to the top of the mixing chamber 54 in a mixing action that also initiates the above mentioned swirl in the general direction of the water flow from duct 84. Simultaneously with the opening of the ports controlled by solenoids 52 and 51 or 53, the whipper motor 46 for the appropriate mixing block 28 or 29 is energized to whip the mixed beverage conventionally to a frothy beverage that is discharged through outlet 56 and spout 95 into the cup 31.

Of course where whipping is not desired, the whipping blade 59 and motor 46 will either be eliminated or disabled. In that event, the water and concentrate from the ducts 84 and 85 will mix and flow spirally several times around the circumference of the mixing chamber 54, then fall by gravity to the bottom of the chamber 54 and through the outlet 56 and spout 95 into the container 31.

We claim:

1. In a post-mix beverage dispenser of the type having an outlet for discharging beverage components in predetermined proportions to provide a serving of dispensed beverage, the improvement which comprises:

a transparent bowl having no fluid connection with the outlet and visibly containing a quantity of fluid;

said fluid being resistant to organic growth and simulating the appearance of the dispensed beverage;

said bowl being positioned relative to the outlet to create the visual impression that said bowl is the reservoir and principal source of the dispensed beverage issuing from the outlet; and said bowl and said quantity of fluid visible within said bowl cooperating to create the visual impression that multiple servings of the dispensed beverage are stored within said bowl.

2. The post-mix dispenser of claim 1 which further comprises means for generating visible movement of said fluid in said bowl.

3. The post-mix dispenser of claim 1 which further comprises a housing to which the outlet and said bowl are mounted.

4. The dispenser of claim 1 wherein said fluid is sterile.

5. The dispenser of claim 4 wherein said fluid comprises an alcohol.

6. A method for inducing sales of a beverage to be dispensed from the outlet of a post-mix beverage dispenser, said method comprising the steps of:

positioning a transparent display bowl relative to the dispenser outlet to create the visual impression that said bowl is the reservoir and principal source from which a serving of the beverage is dispensed;

selecting a display fluid for said bowl which resists formation of organic growth and simulates the appearance of the dispensed beverage; and visibly storing, without dispensing, a quantity of said fluid in said bowl to create the visual impression that multiple servings of the dispensed beverage are stored in said bowl for issuance from the outlet.

7. The method of claim 6 comprising the further step of generating visible movement of said fluid in said bowl.

8. The method of claim 6 comprising the further step of visibly circulating said fluid in said bowl.

9. A beverage dispensing apparatus comprising:

a post-mix dispenser having a dispensing outlet for discharging beverage components in predetermined proportions to provide a serving of dispensed beverage; and a transparent display container having no fluid connection with said outlet and visibly containing a quantity of fluid which simulates the appearance of said dispensed beverage, said fluid being resistant to organic growth;

said container being positioned relative to said outlet to create the visual impression that said container is the reservoir and principal source of said dispensed beverage issuing from said outlet; and said container and said quantity of fluid visible within said container cooperating to create the visual impression that multiple servings of said dispensed beverage are stored within said container.

10. The beverage dispensing apparatus of claim 9 wherein said beverage components-are combined with each other prior to issuance from the outlet.

11. The beverage dispensing apparatus of claim 9 which further comprises a base on which the outlet is mounted, said transparent container being mounted on said base and Positioned generally above said outlet.

12. The dispenser of claim 1 which further comprises a base on which the outlet is mounted, said transparent bowl being mounted on said base and positioned generally above the outlet.

* * * * *